US006516882B2

(12) United States Patent
McGregor et al.

(10) Patent No.: US 6,516,882 B2
(45) Date of Patent: Feb. 11, 2003

(54) APPARATUS AND METHOD FOR GRAVEL PACKING AN INTERVAL OF A WELLBORE

(75) Inventors: Ronald W. McGregor, Carrollton, TX (US); David A. Hejl, Dallas, TX (US); Travis T. Hailey, Jr., Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/906,520

(22) Filed: Jul. 16, 2001

(65) Prior Publication Data

US 2003/0010496 A1 Jan. 16, 2003

(51) Int. Cl.[7] ..... E21B 43/08
(52) U.S. Cl. ..... 166/278; 166/51; 166/233
(58) Field of Search ..... 166/51, 278, 227, 166/230, 233

(56) References Cited

U.S. PATENT DOCUMENTS

| | | | | |
|---|---|---|---|---|
| 2,342,913 | A | 2/1944 | Williams et al. | |
| 2,344,909 | A | 3/1944 | Williams et al. | |
| 4,945,991 | A | 8/1990 | Jones | 166/278 |
| 5,082,052 | A | 1/1992 | Jones et al. | 166/51 |
| 5,113,935 | A | 5/1992 | Jones et al. | 166/51 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Frac Pack Technology Still Evolving," Charles D. Ebinger of Ely & Associated Inc.; Oil & Gas Journal, Oct. 23, 1995.
"Mechanical Fluid–Loss Control Systems Used During Sand Control Operations," H. L. Restarick of Otis Engineering Corp., 1992.
"Sand Control Screens," Halliburton Energy Services, 1994.
"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.
"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.
"CAPS SM Concentric Annular Packing Service for Sand Control," Halliburton Engergy Services, Inc., Aug. 2000.

(List continued on next page.)

*Primary Examiner*—William Neuder
(74) *Attorney, Agent, or Firm*—William M. Inwalle; Lawrence R. Youst

(57) ABSTRACT

An apparatus (60) and method for gravel packing an interval of a wellbore is disclosed. The apparatus (60) comprises a sand control screen (78) positioned within the wellbore and a tubular member (62) disposed within the wellbore forming a first annulus with the sand control screen (78) and a second annulus with the wellbore. The tubular member (62) has an axially extending production section (64) with a plurality of openings (66) and an axially extending nonproduction section (68) with a plurality of outlets (70). A channel (72) is disposed within the first annulus such that the channel (72) is substantially circumferentially aligned with the nonproduction section (68) of the tubular member (62) forming a slurry passageway (74) therewith.

36 Claims, 11 Drawing Sheets

U.S. PATENT DOCUMENTS

| | | | | | |
|---|---|---|---|---|---|
| 5,161,613 | A | | 11/1992 | Jones | 166/242 |
| 5,161,618 | A | | 11/1992 | Jones et al. | 166/308 |
| 5,333,688 | A | | 8/1994 | Jones et al. | 166/278 |
| 5,355,956 | A | | 10/1994 | Restarick | 166/296 |
| 5,390,966 | A | | 2/1995 | Cox et al. | 285/137.1 |
| 5,419,394 | A | | 5/1995 | Jones | 166/51 |
| 5,443,117 | A | | 8/1995 | Ross | 166/51 |
| 5,476,143 | A | * | 12/1995 | Sparlin et al. | 166/233 |
| 5,515,915 | A | | 5/1996 | Jones et al. | 166/51 |
| 5,588,487 | A | | 12/1996 | Bryant | 166/51 |
| 5,636,691 | A | | 6/1997 | Hendrickson et al. | 166/278 |
| 5,755,286 | A | | 5/1998 | Ebinger | 166/281 |
| 5,842,516 | A | | 12/1998 | Jones | 166/56 |
| 5,848,645 | A | | 12/1998 | Jones | 166/280 |
| 5,868,200 | A | | 2/1999 | Bryant et al. | 166/51 |
| 5,890,533 | A | | 4/1999 | Jones | 166/51 |
| 5,921,318 | A | | 7/1999 | Ross | 166/250.17 |
| 5,934,376 | A | | 8/1999 | Nguyen et al. | 166/278 |
| 6,003,600 | A | | 12/1999 | Nguyen et al. | 166/281 |
| 6,047,773 | A | | 4/2000 | Zeltmann et al. | 166/281 |
| 6,059,032 | A | | 5/2000 | Jones | 166/278 |
| 6,109,356 | A | * | 8/2000 | Echols et al. | 166/386 |
| 6,116,343 | A | | 9/2000 | Van Petegem et al. | 166/297 |
| 6,125,932 | A | * | 10/2000 | Hamid et al. | 166/233 |
| 6,125,933 | A | | 10/2000 | Ross | 166/250.01 |
| 6,220,345 | B1 | | 4/2001 | Jones et al. | 166/51 |
| 6,227,303 | B1 | | 5/2001 | Jones | 166/378 |
| 6,230,803 | B1 | | 5/2001 | Morton et al. | 166/278 |
| 6,343,651 | B1 | | 2/2002 | Bixeman | 166/278 |

OTHER PUBLICATIONS

"Caps$^{SM}$ Control Service for Horizontal Completions Improves Gravel Pack Reliability and Increases Production Potential from Horizontal Completions," Halliburton Energy Services, Inc., Aug., 2000.

* cited by examiner

APPARATUS AND METHOD FOR GRAVEL PACKING AN INTERVAL OF A WELLBORE

TECHNICAL FIELD OF THE INVENTION.

This invention relates in general to preventing the production of particulate materials through a wellbore traversing an unconsolidated or loosely consolidated subterranean formation and, in particular, to an apparatus and method for obtaining a substantially complete gravel pack within an interval of the wellbore.

BACKGROUND OF THE INVENTION

Without limiting the, scope of the present invention, its background is described with reference to the production of hydrocarbon fluids through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulates. For example, the particulates cause abrasive wear to components within the well, such as tubing, pumps and valves. In addition, the particulates may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the, well adjacent to the unconsolidated or loosely consolidated production interval. In a typical gravel pack completion, a sand control screen is lowered into the wellbore on a workstring to a position proximate the desired production interval. A fluid slurry including a liquid carrier and a particulate material known as gravel is then pumped down the workstring and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulates carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge.

It has been found, however, that shunt tubes installed on the exterior of sand control screens are susceptible to damage during installation and may fail during a gravel packing operation. Also, it has been found that to cost of fabricating such shunt tube systems is high. In addition, it has been found, that it is difficult and time consuming to make all of the necessary fluid connections between the numerous joints of shunt tubes required for typical production intervals.

Therefore a need has arisen for an apparatus and method for gravel packing a production interval traversed by a wellbore that overcomes the problems created by sand bridges. A need has also arisen for such an apparatus that is not susceptible to damage during installation and will not fail during a gravel packing operation. Further, a need has arisen for such an apparatus that is cost effective and not difficult or time consuming to assemble.

SUMMARY OF THE INVENTION

The present invention disclosed herein comprises an apparatus and method for gravel packing a production interval of a wellbore that traverses an unconsolidated or loosely consolidated formation that overcomes the problems created by the development of a sand bridge between a sand control screen and the wellbore. Importantly, the apparatus of the present invention is not susceptible to damage during installation or failure during the gravel packing operation, is cost effective to manufacture and is not difficult or time consuming to assemble.

The apparatus comprises a sand control screen that is positioned within the wellbore and a tubular member disposed around the sand control screen forming a first annulus with the sand control screen and a second annulus with the wellbore. The tubular member has an axially extending production section with a plurality of openings and an axially extending nonproduction section with a plurality of outlets. A channel, that is disposed within the first annulus, is substantially circumferentially aligned with the nonproduction section of the tubular member to form a slurry passageway.

The channel has a web and a pair of oppositely disposed sides that from an angle with the web of between about 45 and 90 degrees. The ends of the sides may be square or may be rolled. In either case, the sides contact the inner surf ace of the tubular member when the pressure within the slurry passageway is below a predetermined value.

When the pressure within the slurry passageway is above the predetermined value, however, the sides will separate from the inner surface of the tubular member to relieve pressure. The pressure relief capability is allowed as the channel is attached to the tubular member with attachment members that connect the web of the channel to the tubular member leaving the sides free to deform. Alternatively, the channel may be connected to the sand control screen.

In some embodiments, the tubular member will have more than one axially extending production section and more than one axially extending nonproduction section. In these embodiments, a channel corresponds to each of the nonproduction sections such that more than one slurry passageway is created.

One method for gravel packing an interval of a wellbore of the present invention comprises traversing a formation with the wellbore, locating a sand control screen within the wellbore proximate the formation, positioning a tubular member within the wellbore forming a first annulus with the sand control screen and a second annulus with the wellbore, disposing a channel within the first annulus such that the channel is substantially circumferentially aligned with a nonproduction section of the tubular member forming a slurry passageway, injecting a fluid slurry containing gravel through the slurry passageway such that the fluid slurry exits the slurry passageway through outlets and terminating the injecting when the interval is completely packed with the gravel.

This method may also include contacting the sides of the channel with an inner surface of the tubular member when the pressure within the slurry passageway is below a predetermined value and relieving pressure from the slurry passageway by allowing the sides of the channel to temporarily separate from the inner surface of the tubular member when the pressure within the slurry passageway is above the predetermined value.

Accordingly, the apparatus and method of the present invention overcome the problems associated with the formation of sand bridges. Specifically, if a sand bridge forms, the fluid slurry bypasses the sand bridge by traveling within the apparatus of the present invention. Thereafter, the fluid slurry exits the apparatus of the present invention allowing the gravel in the slurry to be deposited in the second annulus such that a complete gravel pack of the interval can be achieved.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
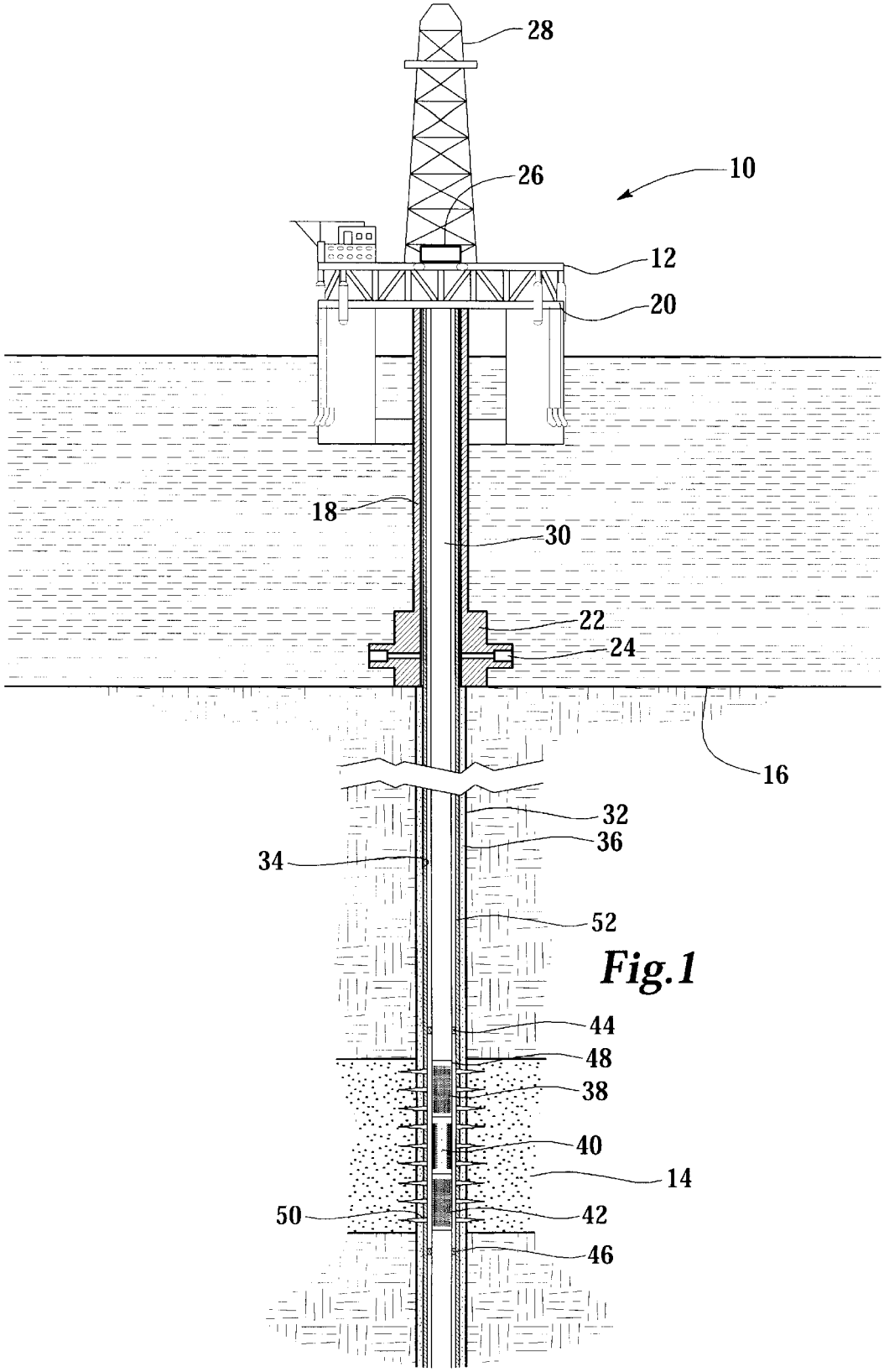
FIG. 1 is a schematic illustration of an offshore oil and gas platform operating an apparatus for gravel packing an interval of a wellbore of the present invention.

Referring initially to FIG. 1, several apparatuses for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 include various tools including apparatuses 38, 40, 42 for gravel packing an interval of wellbore 32 adjacent to formation 14 between packers 44, 46 and into annular region or interval 48. When it is desired to gravel pack annular interval 48, work string 30 is lowered through casing 34 until apparatuses 38, 40, 42 are positioned adjacent to formation 14 including perforations 50. Thereafter, a fluid slurry including a liquid carrier and a particulate material such as gravel is pumped down workstring 30.

As explained in more detail below, the fluid slurry may be injected entirely into apparatus 38 and sequentially flow through apparatuses 40, 42. During this process, portions of the fluid slurry exit each apparatus 38, 40, 42 such that the fluid slurry enters annular interval 48. Once in annular interval 48, a portion the gravel in the fluid slurry is deposited therein. Some of the liquid carrier may enter formation 14 through perforation 50 while the remainder of the fluid carrier, along with some of the gravel, reenters certain sections of apparatuses 38, 40, 42 depositing gravel therein. As numerous sections of sand control screens (not pictured) are positioned within apparatuses 38, 40, 42, the gravel remaining in the fluid slurry is disallowed from further migration. The liquid carrier, however, can travel through the sand control screens and up to the surface in a known manner, such as through a wash pipe and into the annulus 52 above packer 44. The fluid slurry is pumped down workstring 30 through apparatuses 38, 40, 42 until annular interval 48 surrounding apparatuses 38, 40, 42 and portions of apparatuses 38, 40, 42 are filled with gravel.

Alternatively, instead of injecting the entire stream of fluid slurry into apparatuses 38, 40, 42, all or a portion of the fluid slurry could be injected directly into annular interval 48 in a known manner such as through a crossover tool (not pictured) which allows the slurry to travel from the interior of workstring 30 to the exterior of workstring 30. Again, once this portion of the fluid slurry is in annular interval 48, a portion of the gravel in the fluid slurry is deposited in annular interval 48. Some of the liquid carrier may enter formation 14 through perforation 50 while the remainder of the fluid carrier along with some of the gravel enters certain sections of apparatuses 38, 40, 42 depositing gravel therein. The sand control screens (not pictured) within apparatuses 38, 40, 42 disallow further migration of the gravel but allows the liquid carrier to travel therethrough and up to the surface. If the fluid slurry is entirely or partially injected directly into annular interval 48 and a sand bridge forms, the fluid slurry will be diverted into apparatuses 38, 40, 42 to bypass this sand bridge such that a complete pack can nonetheless be achieved.

Even though FIG. 1 depicts a vertical well, it should be noted by one skilled in the art that the apparatus for gravel packing an interval of a wellbore of the present invention is equally well-suited for use in deviated wells, inclined wells or horizontal wells. Also, even though FIG. 1 depicts an offshore operation, it should be noted by one skilled in the art that the apparatus for gravel packing an interval of a wellbore of the present invention is equally well-suited for use in onshore operations.

Figure 2:
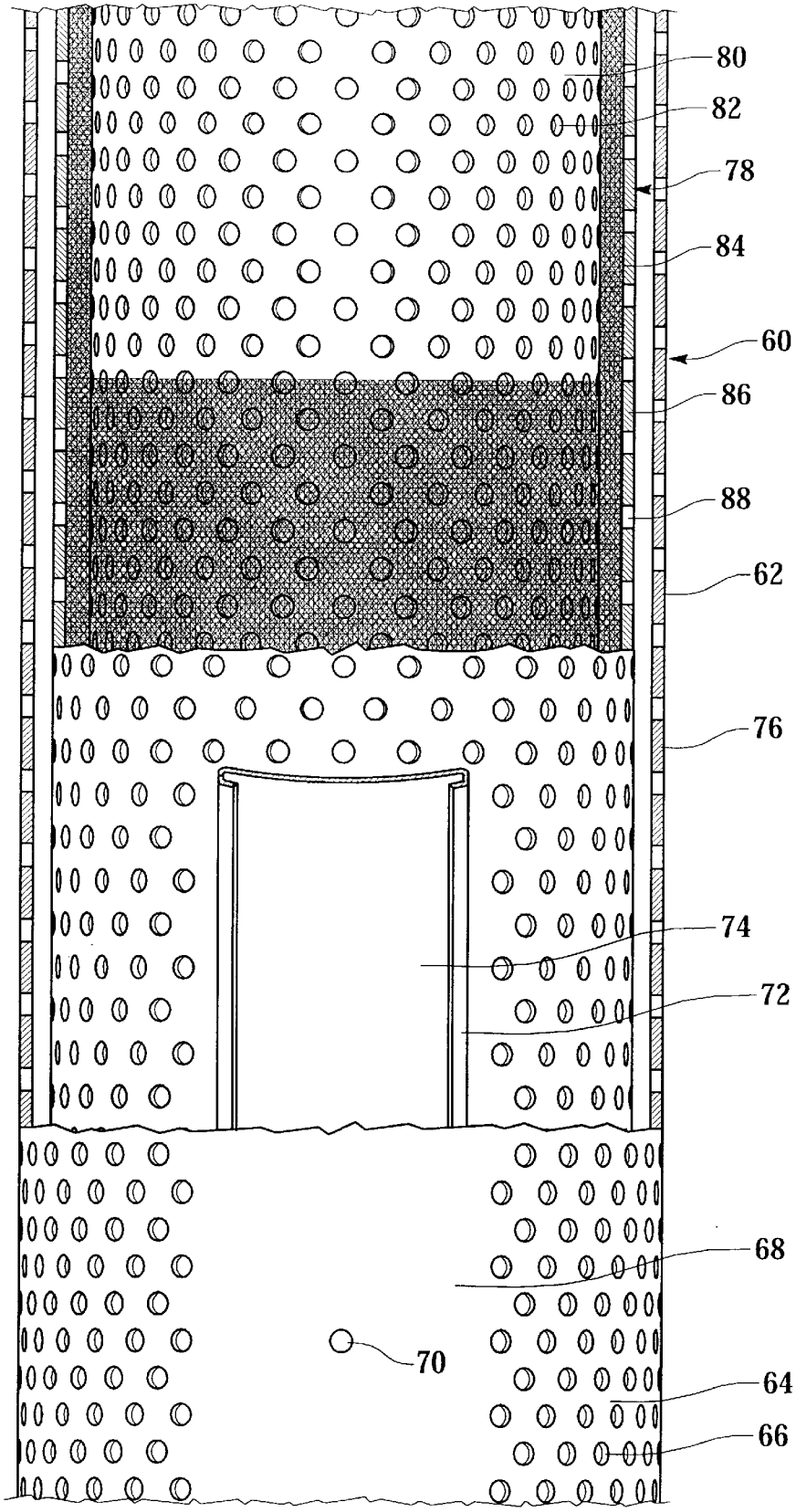
FIG. 2 is partial cut away view of an apparatus for gravel packing an interval of a wellbore of the present invention in position around a sand control screen.

Referring now to FIG. 2, therein is depicted a partial cut away view of an apparatus for gravel packing an interval of a wellbore of the present invention that is positioned around a sand control screen and generally designated 60. Apparatus 60 has an outer tubular 62. A portion of the side wall of outer tubular 62 is an axially extending production section 64 that includes a plurality of openings 66. Another portion of the side wall of outer tubular 62 is an axially extending nonproduction section 68 that includes one or more outlets 70. For reasons that will become apparent to those skilled in the art, the density of opening 66 within production section 64 of outer tubular 62 is much greater than the density of outlets 70 in nonproduction section 68 of outer tubular 62. Also, it should be noted by those skilled in the art that even though FIG. 2 has depicted openings 66 and outlet 70 as being circular, other shaped openings may alternatively be used without departing from the principles of the present invention. Likewise, even though FIG. 2 has depicted openings 66 as being the same size as outlet 70, openings 66 could alternatively be larger or smaller than outlet 70 without departing from the principles of the present invention. In addition, the exact number, size and shape of openings 66 are not critical to the present invention, so long as sufficient area is provided for fluid production therethrough and the integrity of outer tubular 62 is maintained.

Disposed within outer tubular 62 and on opposite sides of each other is a pair of channels 72, only one channel 72 being visible. Channels 72 provide substantial circumferential fluid isolation between production section 64 and nonproduction section 68 of outer tubular 62 with pressure relief capability as explained in more detail below. As such, channels 72 define the circumferential boundary between a slurry passageway 74, having an outer radial boundary defined by nonproduction section 68 of outer tubular 62 and a production pathway 76, having an outer radial boundary defined by production section 64 of outer tubular 62.

Disposed within channels 72 is a sand control screen assembly 78. Sand control screen assembly 78 includes a base pipe 80 that has a plurality of openings 82 which allow the flow of production fluids into the production tubing. The exact number, size and shape of openings 82 are not critical to the present invention, so long as sufficient area is provided for fluid production and the integrity of base pipe 80 is maintained.

Positioned around base pipe 80 is a fluid-porous, particulate restricting, sintered metal material such as plurality of layers of a wire mesh that are sintered together to form a porous sintered wire mesh screen 84. Screen 84 is designed to allow fluid flow therethrough but prevent the flow of particulate materials of a predetermined size from passing therethrough. Positioned around screen 84 is a screen housing 86 that has a plurality of openings 88 which allow the flow of production fluids therethrough. The exact number, size and shape of openings 88 is not critical to the present invention, so long as sufficient area is provided for fluid production and the integrity of housing 86 is maintained.

Figure 3:
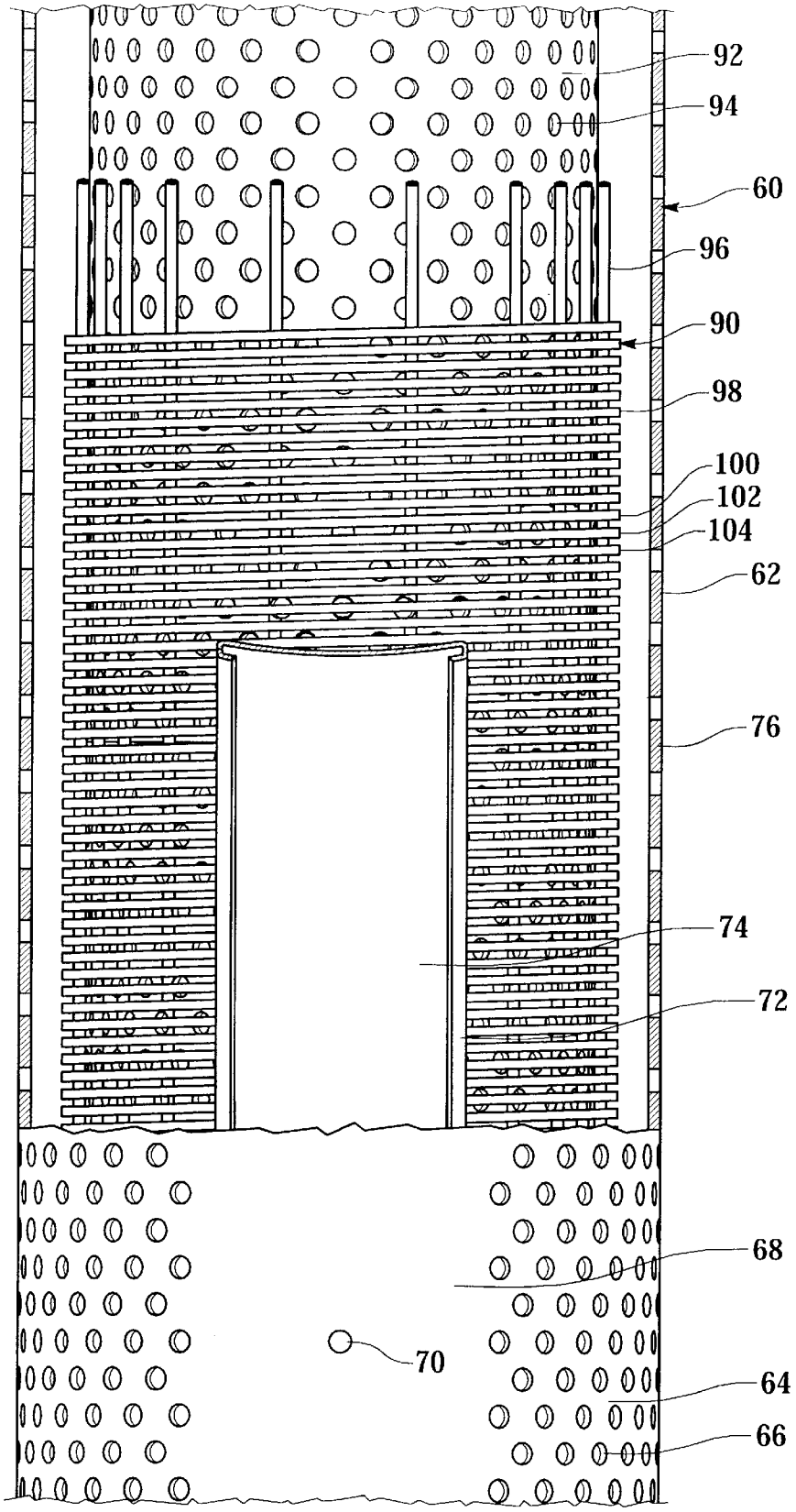
FIG. 3 is partial cut away view of an apparatus for gravel packing an interval of a wellbore of the present invention in position around a sand control screen.

It should be understood by those skilled in the art that other types of filter media may be used in conjunction with apparatus 60. For example, as seen in FIG. 3, a wire wrap screen assembly 90 may alternately be used. Screen assembly 90 has a base pipe 92 that has a plurality of openings 94. A plurality of ribs 96 are spaced around base pipe 92. Ribs 96 are generally symmetrically distributed about the axis of base pipe 92. Ribs 96 are depicted as having a cylindrical cross section, however, it should be understood by one skilled in the art that ribs 96 may alternatively have a rectangular or triangular cross section or other suitable geometry. Additionally, it should be understood by one skilled in the art that the exact number of ribs 96 will be dependent upon the diameter of base pipe 92 as well as other design characteristics that are well known in the art.

Wrapped around ribs 96 is a screen wire 98. Screen wire 98 forms a plurality of turns, such as turn 100, turn 102 and turn 104. Between each of the turns is a gap through which formation fluids flow. The number of turns and the gap between the turns are determined based upon the characteristics of the formation from which fluid is being produced and the size of the gravel to be used during the gravel packing operation. Together, ribs 96 and screen wire 98 may form a sand control screen jacket which is attached to base pipe 92 by welding or other suitable technique.

Figure 4:
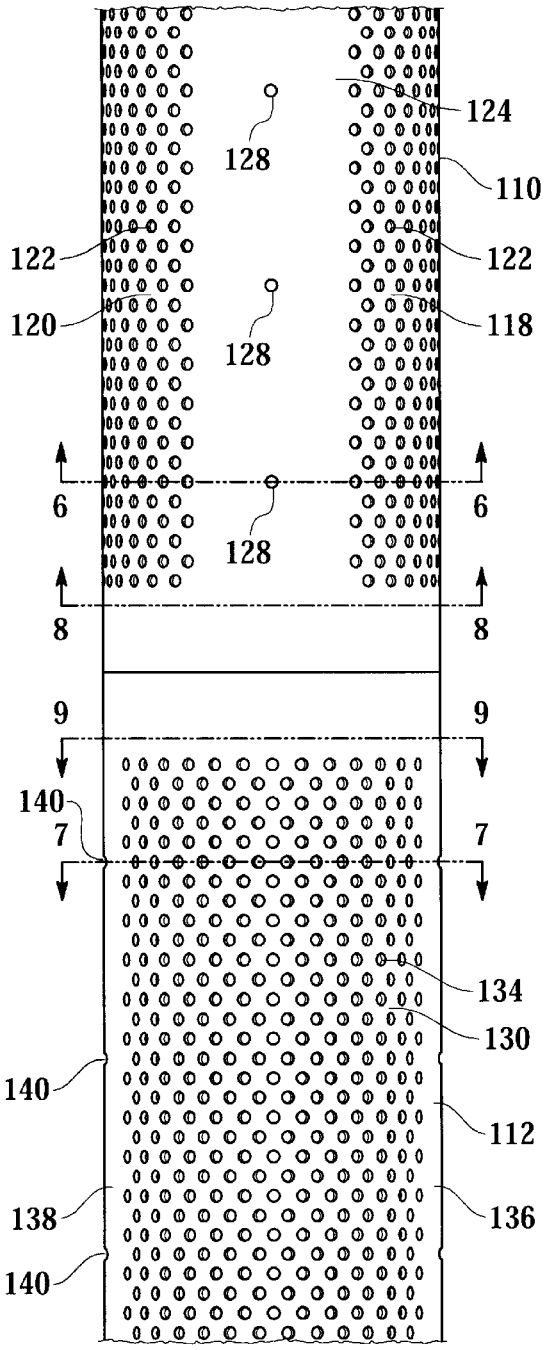
FIG. 4 is a side view of two adjacent sections of outer tubulars of an apparatus for gravel packing an interval of a wellbore of the present invention that are coupled together.
Figure 5:
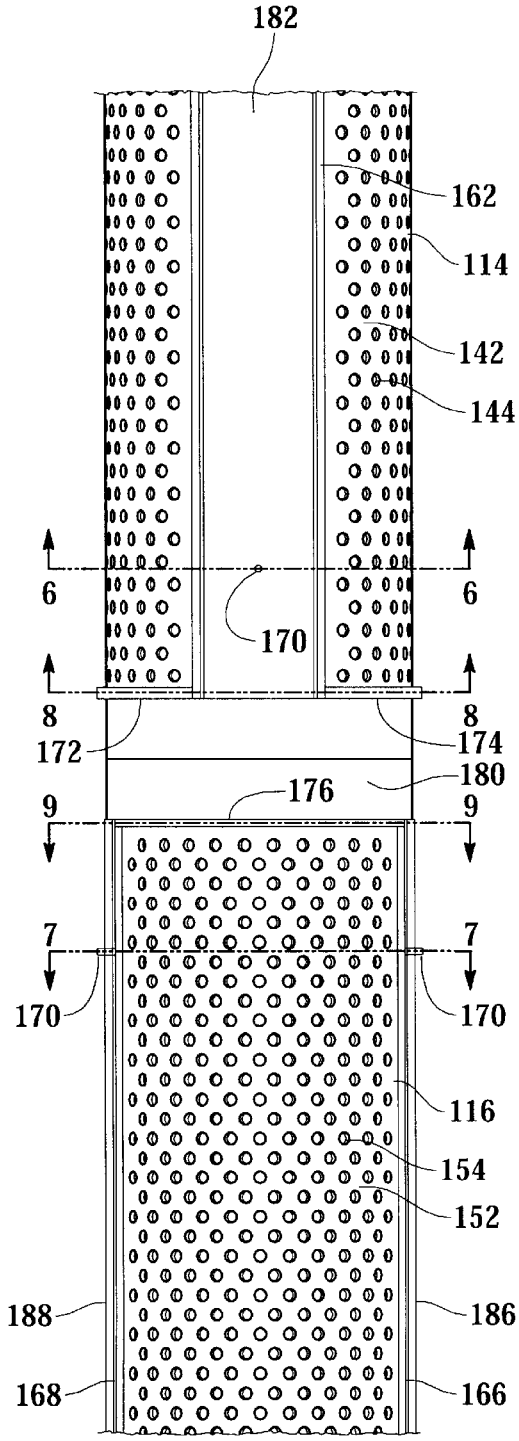
FIG. 5 is a side view of two adjacent sections of sand control screens having channels of an apparatus for gravel packing an interval of a wellbore of the present invention positioned in relation thereto.

Referring now to FIGS. 4 and 5, therein is depicted two adjacent sections of outer tubulars designated 110 and 112 and corresponding portions of two adjacent sections of sand control screen assemblies designated 114 and 116, respectively. Outer tubular 110 has two axially extending production sections 118, 120 each including a plurality of openings 122. Outer tubular 110 also has two axially extending nonproduction sections 124, 126, only one of which is visible in FIG. 3. Each nonproduction section 124, 126 includes several outlets 128. Likewise, outer tubular 112 has two axially extending production sections 130, 132, only one of which is visible in FIG. 3. Each production section 130, 132 includes a plurality of openings 134. Outer tubular 112 also has two axially extending nonproduction sections 136, 138, each of which includes several outlets 140. As should become apparent to those skilled in the art, even though FIG. 4 depicts outer tubular 110 and outer tubular 112 at a ninety-degree circumferential phase shift relative to one another, any degree of circumferential phase shift is acceptable using the present invention as the relative circumferential positions of adjoining sections of the apparatuses for gravel packing an interval of a wellbore of the present invention does not affect the operation of the present invention. As such, the mating of adjoining sections of the apparatuses for gravel packing an interval of a wellbore of the present invention is substantially similar to mating typical joints of pipe to form a pipe string requiring no special coupling tools or techniques.

Figure 6:
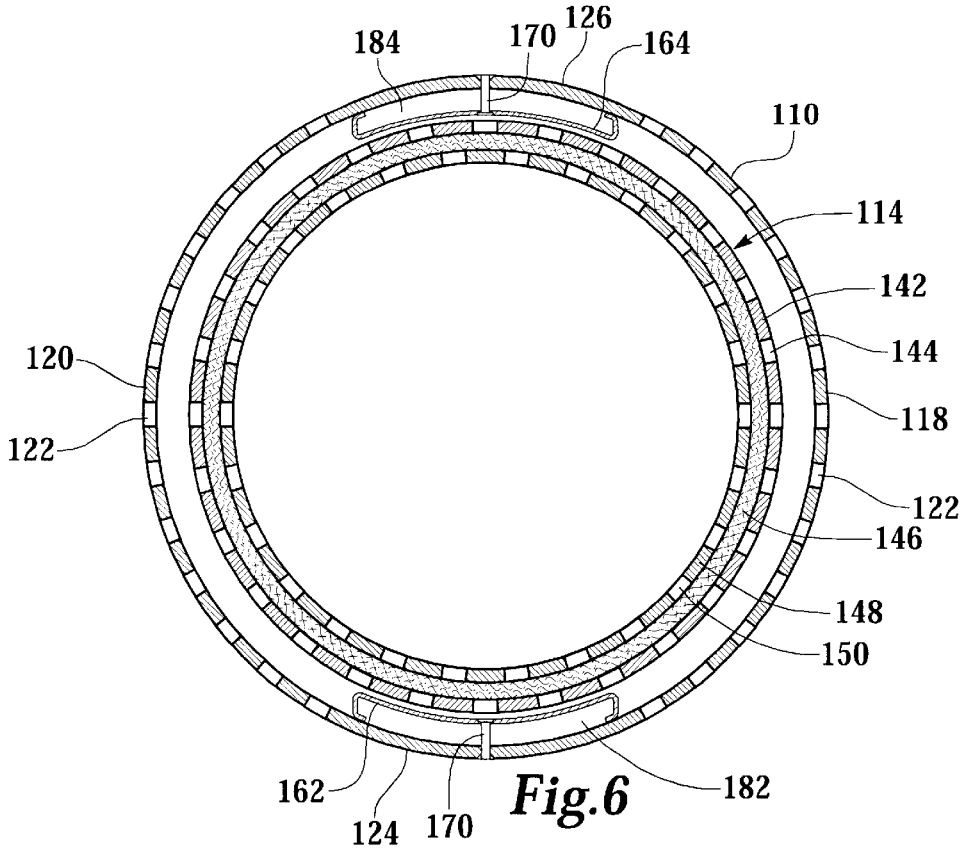
FIG. 6 is a cross sectional view of an apparatus for gravel packing an interval of a wellbore of the present invention positioned around a sand control screen and taken along line 6—6 of FIGS. 4 and 5.
Figure 7:
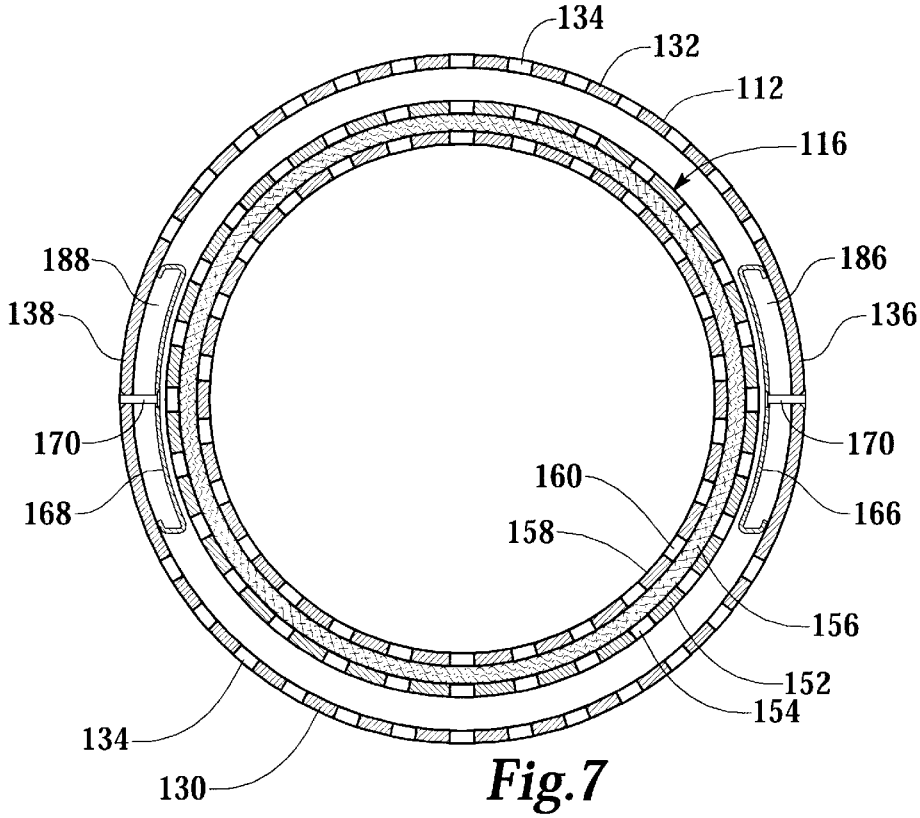
FIG. 7 is a cross sectional view of an apparatus for gravel packing an interval of a wellbore of the present invention positioned around a sand control screen and taken along line 7—7 of FIGS. 4 and 5.

Screen assembly 114 includes screen housing 142 having a plurality of perforations 144, porous sintered wire mesh screen 146 and base pipe 148 having a plurality of perforations 150, as best seen in FIG. 6. Likewise, screen assembly 116 includes screen housing 152 having a plurality of perforations 154, a porous sintered wire mesh screen 156 and base pipe 158 having a plurality of perforations 160, as best seen in FIG. 7. Positioned adjacent to screen assembly 114 are channels 162, 164 only channel 162 being visible in FIG. 5. Positioned adjacent to screen assembly 116 are channels 166, 168.

In the illustrated embodiment, screen assembly 114 and channels 162, 164 would be positioned within outer tubular 110 and screen assembly 116 and channels 166, 168 would be positioned within outer tubular 112, as best seen in FIGS. 6 and 7, respectively. Channels 162, 164 are circumferentially aligned with nonproduction sections 124, 126 of outer tubular 110, as best seen in FIG. 6. Channels 166, 168 are circumferentially aligned with nonproduction sections 136, 138 of outer tubular 112, as best seen in FIG. 7.

As illustrated, channels 162, 164 are attached to outer tubular 110 with studs 170. Likewise, channels 166, 168 are attached to outer tubular 112 with studs 170. Studs 170 have heads that are received by the channels and shanks that extend into the openings of an outer tubular, such as certain of the openings 128 of outer tubular 110 and certain of the openings 140 of outer tubular 112. The shank portion of studs 170 is welded within the openings to secure channels 162, 164, 166, 168 in their respective positions.

The use of studs 170 makes assembly of the apparatus for gravel packing an interval of a wellbore of the present invention relatively easy and allows for a pressure relief feature of the present invention that will be discussed in more detail below. For example, once the studs are position along the length of a channel at increments of preferably between about one and three feet, each channel is inserted into the inside of an outer tubular such that the studs are aligned with openings in the outer tubular. The studs may then be extended through the openings by pushing the channels radially outwardly to a predetermined distance toward the inner surface of the outer tubular. The studs may then be welded to the outer tubular. Any portion of the stud extending beyond the outer surface of the outer tubular may be ground off to create a substantially smooth outer surface on the outer tubular.

It should be noted, however, by those skilled in the art that even though the attachment device described with reference to FIGS. 4–7 is a stud, other attachment devices or methods could alternatively be used without departing from the principles of the present invention, including, but not limited to, threaded bolts or welding the channel directly to the outer tubular or attaching the channel directly to the sand control screen.

Figure 8:
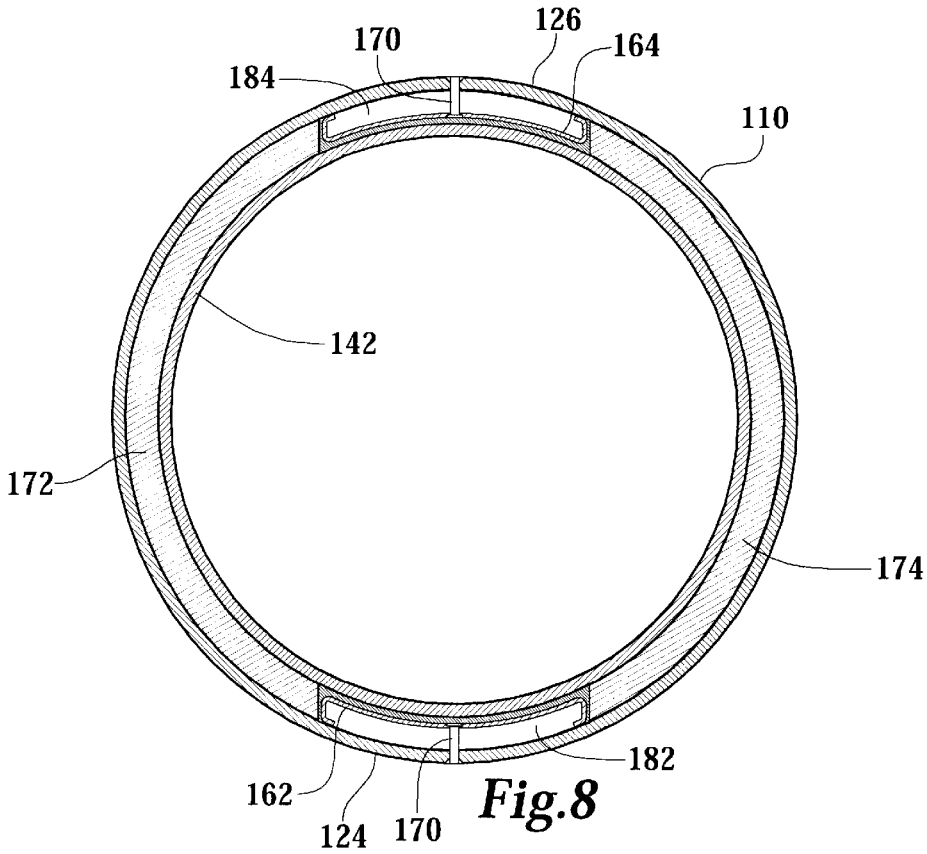
FIG. 8 is a cross sectional view of an apparatus for gravel packing an interval of a wellbore of the present invention positioned around a sand control screen and taken along line 8—8 of FIGS. 4 and 5.
Figure 9:
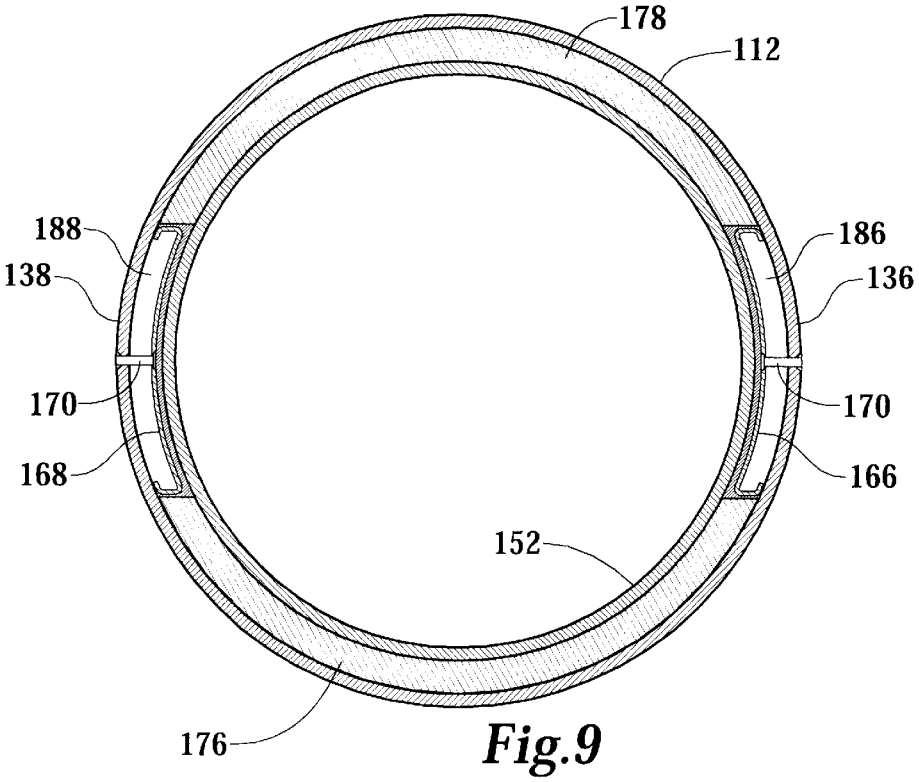
FIG. 9 is a cross sectional view of an apparatus for gravel packing an interval of a wellbore of the present invention positioned around a sand control screen and taken along line 9—9 of FIGS. 4 and 5.

Referring to FIGS. 5 and 8, positioned at both ends of channels 162, 164 and between outer tubular 110 and screen housing 142 are two sets of isolation members, only isolation members 172, 174 being visible. Likewise, positioned at both ends of channels 166, 168 and between outer tubular 112 and screen housing 152 are two sets of isolation members, only isolation members 176, 178 being visible and best seen in FIGS. 5 and 9. The isolation members are attached to adjacent sections of the outer tubulars, channels and screen housings to help direct the flow of the gravel slurry from the slurry passageways defined by channels 162, 164 to the slurry passageways defined by channels 166, 168.

As such, the slurry passageways of adjacent sections of the apparatuses for gravel packing an interval of a wellbore of the present invention are in fluid communication with one another such that a fluid slurry may travel in and between these passageways from one section of the apparatuses for gravel packing an interval of a wellbore of the present invention to the next. Specifically, as best seen in FIGS. 4, 5, 8 and 9 collectively, an annular region 180 exists between outer tubulars 110, 112 and screen assemblies 114, 116 that allows the fluid slurry to travel from slurry passageways 182, 184 through annular regions 180 into slurry passageways 186, 188. Accordingly, regardless of the circumferential orientation of outer tubular 110 relative to outer tubular 112, the fluid slurry will travel down through each section of the apparatuses for gravel packing an interval of a wellbore of the present invention.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that the apparatus for gravel packing an interval of a wellbore is not limited to such orientation as it is equally-well suited for use in inclined and horizontal orientations.

Figure 10:
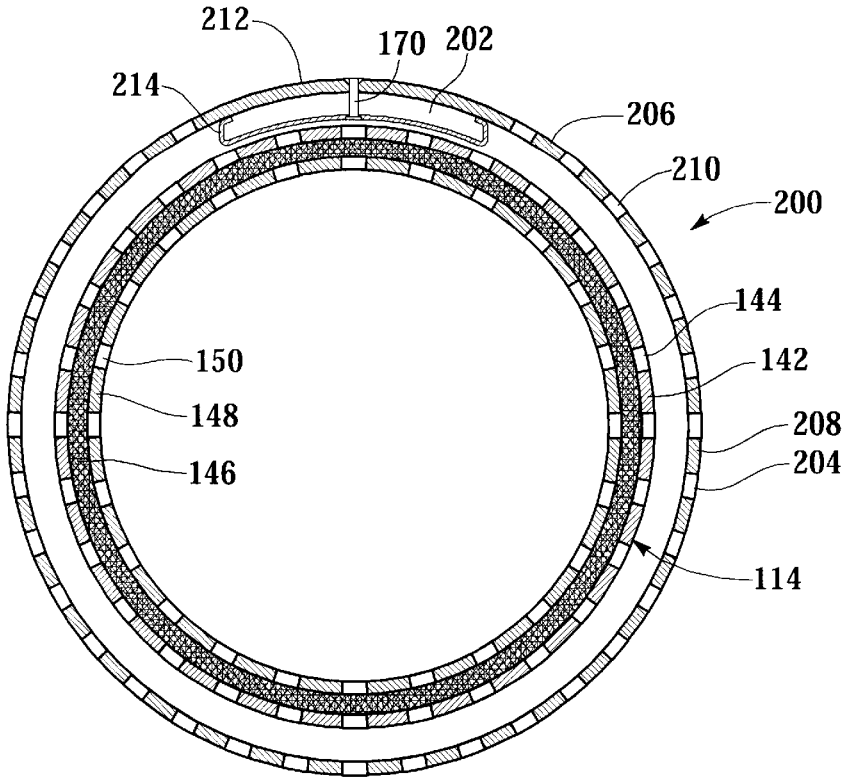
FIG. 10 is a cross sectional view of an alternate embodiment of an apparatus for gravel packing an interval of a wellbore of the present invention positioned around a sand control screen.
Figure 11:
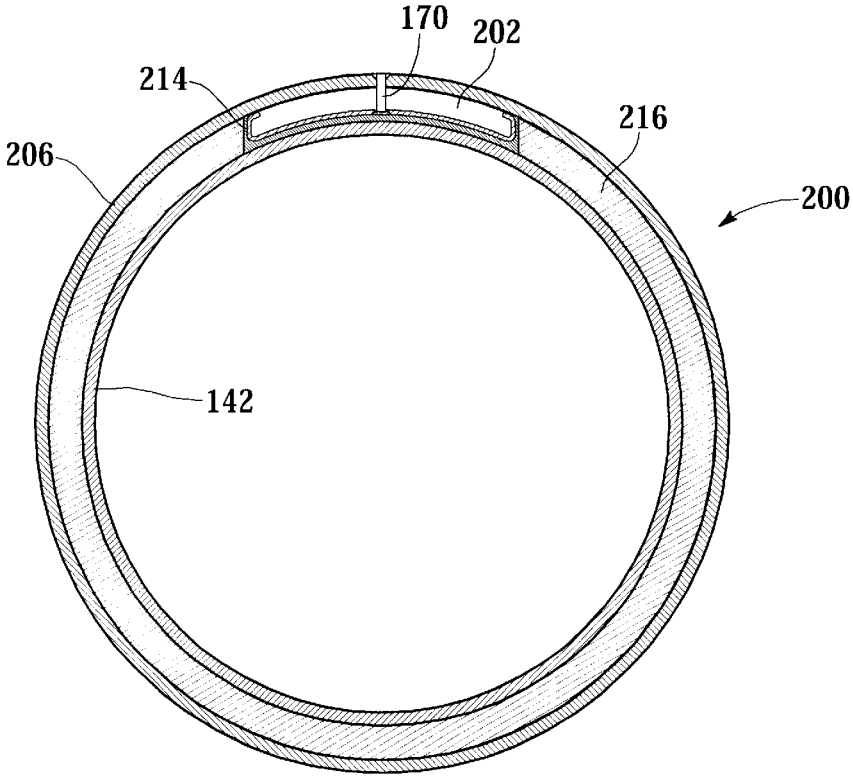
FIG. 11 is a cross sectional view of an alternate embodiment of an apparatus for gravel packing an interval of a wellbore of the present invention positioned around a sand control screen.

Referring now to FIGS. 10 and 11, therein are depicted cross sectional views of an alternate embodiment of an apparatus for gravel packing an interval of a wellbore that is generally designated 200. Apparatus 200 is similar to that shown in FIGS. 6 and 8 except apparatus 200 has a single slurry passageway 202 and a single production pathway 204. Specifically, apparatus 200 has an outer tubular 206 including a production section 208 having a plurality of openings 210 and a nonproduction section 212. Apparatus 200 is positioned over sand control screen assembly 114 including screen housing 142 having perforations 144, screen 146 and base pipe 148 having a plurality of perforations 150. A channel 214 is positioned between outer tubular 206 and screen assembly 114 which defines slurry passageway 202.

Channel 214 is attached to outer tubular 206 with a plurality of studs 170. An isolation member 216, as best seen in FIG. 11, helps direct the fluid slurry as described above.

Figure 12:
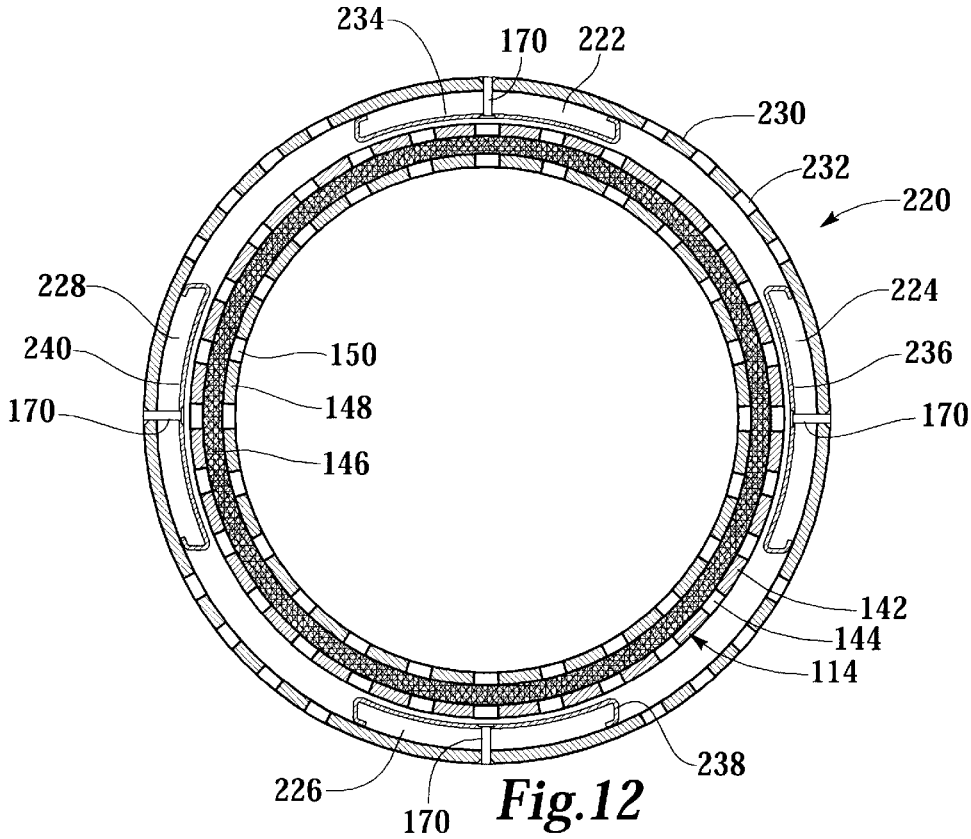
FIG. 12 is a cross sectional view of an alternate embodiment of an apparatus for gravel packing an interval of a wellbore of the present invention positioned around a sand control screen.
Figure 13:
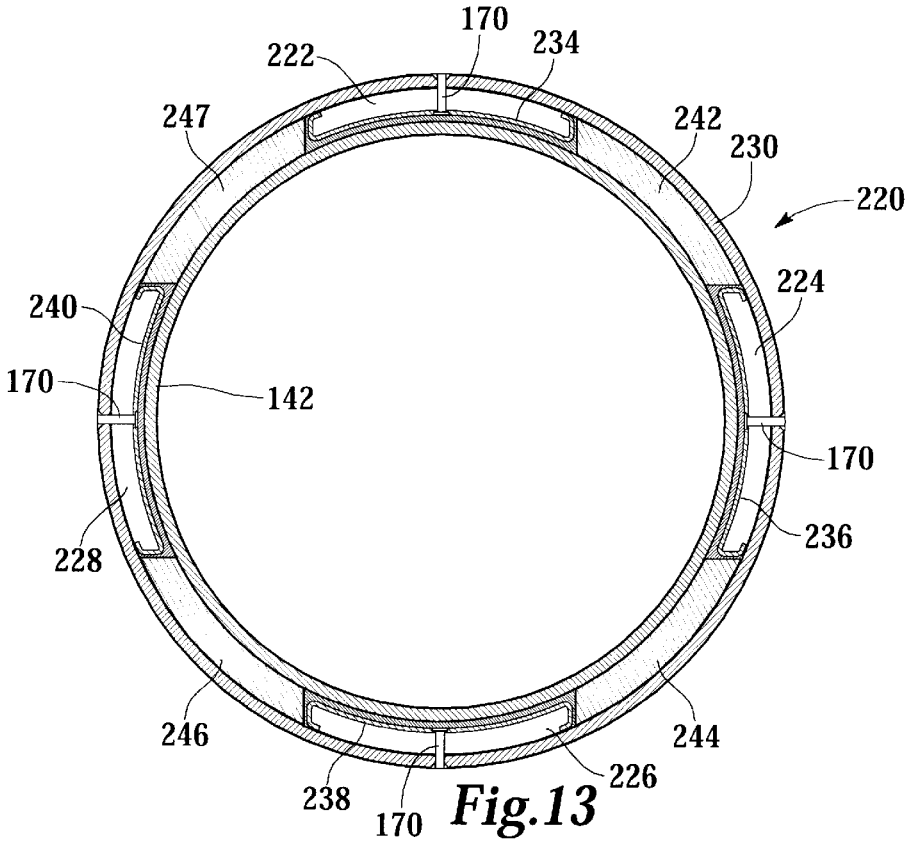
FIG. 13 is a cross sectional view of an alternate embodiment of an apparatus for gravel packing an interval of a wellbore of the present invention positioned around a sand control screen.

Referring now to FIGS. 12 and 13, therein are depicted cross sectional views of another embodiment of an apparatus for gravel packing an interval of a wellbore that is generally designated 220. Apparatus 220 is similar to that shown in FIGS. 6 and 8 except apparatus 220 has four slurry passageways 222, 224, 226, 228. Specifically, apparatus 220 has an outer tubular 230 including a plurality of openings 232. Apparatus 220 is position around sand control screen assembly 114. Four channels 234, 236, 238, 240 are attached to outer tubular 230. Four isolation members 242, 244, 246, 247 are positioned between outer tubular 230 and sand control screen assembly 114.

As should be apparent from FIGS. 4–13, the apparatus for gravel packing an interval of a wellbore of the present invention may have a variety of configurations including configuration having one, two and four slurry passageways. Other configurations having other numbers of slurry passageways are also possible and are considered within the scope of the present invention.

In addition, it should be understood by those skilled in the art that use of various configurations of the apparatus for gravel packing an interval of a wellbore of the present invention in the same interval is likely and may be preferred. Specifically, it may be desirable to have a volumetric capacity within the slurry passageways that is greater toward the top, in a vertical well, or heel, in an inclined or horizontal well, of a string of consecutive apparatuses of the present invention than toward the bottom or toe of the interval. This may be achieved by using apparatuses of the present invention having more slurry passageways near the top or heel of the interval and less slurry passageways near the bottom or toe of the interval. This may also be achieved by using apparatuses of the present invention having wider slurry passageways near the top or heel of the interval and narrower slurry passageways near the bottom or toe of the interval.

Figure 14:
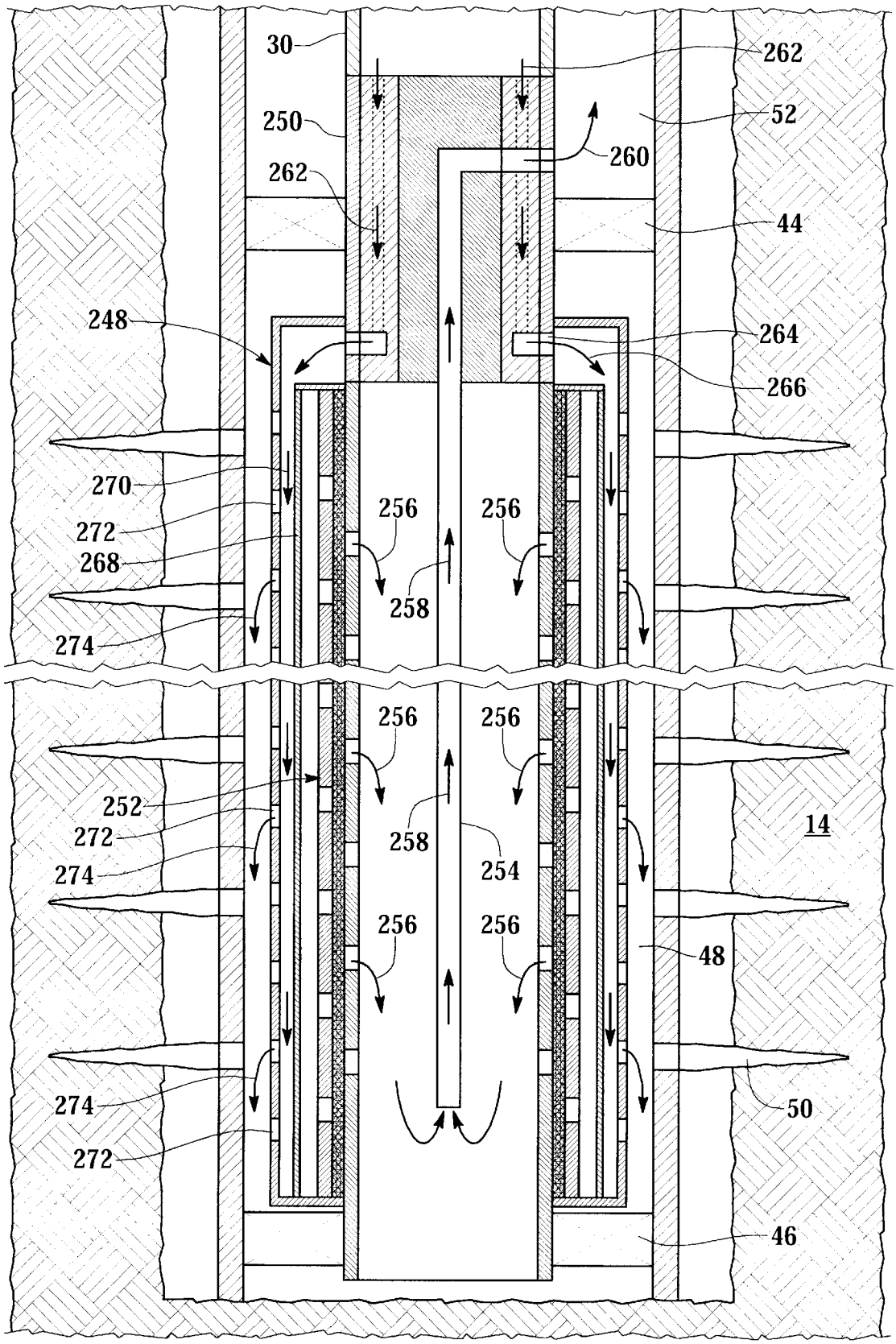
FIG. 14 is a half sectional view depicting the operation of an apparatus for gravel packing an interval of a wellbore of the present invention.

Referring now to FIG. 14, a typical completion process using an apparatus 248 for gravel packing an interval of a wellbore of the present invention will be described. First, interval 48 adjacent to formation 14 is isolated. Packer 44 seals the upper end of annular interval 48 and packer 46 seals the lower end of annular interval 48. Cross-over assembly 250 is located adjacent to screen assembly 252, traversing packer 44 with portions of cross-over assembly 250 on either side of packer 44. When the gravel packing operation commences, the objective is to uniformly and completely fill interval 48 with gravel. To help achieve this result, wash pipe 254 is disposed within screen assembly 252. Wash pipe 254 extends into cross-over assembly 250 such that return fluid passing through screen assembly 252, indicated by arrows 256, may travel through wash pipe 254, as indicated by arrow 258, and into annulus 52, as indicted by arrow 260, for return to the surface.

The fluid slurry containing gravel is pumped down work string 30 into cross-over assembly 250 along the path indicated by arrows 262. The fluid slurry containing gravel exits cross-over assembly 250 through cross-over ports 264 and is discharged into apparatus 248 as indicated by arrows 266. In the illustrated embodiment, the fluid slurry containing gravel then travels between channels 268 and the non-production sections of the outer tubular of apparatus 248 as indicated by arrows 270. At this point, portions of the fluid slurry containing gravel exit apparatus 248 through outlets 272 as indicated by arrows 274. As the fluid slurry containing gravel enters annular interval 48, the gravel drops out of the slurry and builds up from formation 14, filling perforations 50 and annular interval 48 around screen assembly 52 forming the gravel pack. Some of the carrier fluid in the slurry may leak off through perforations 50 into formation 14 while the remainder of the carrier fluid passes through screen assembly 252, as indicated by arrows 256, that is sized to prevent gravel from flowing therethrough. The fluid flowing back through screen assembly 252, as explained above, follows the paths indicated by arrows 258, 260 back to the surface.

In operation, the apparatus for gravel packing an interval of a wellbore of the present invention is used to distribute the fluid slurry to various locations within the interval to be gravel packed by injecting the fluid slurry into the slurry passageways created by the channels and the outer tubular of one or more sections of the apparatuses. The fluid slurry exits through the various outlets along the slurry passageway and enters the annulus between the apparatus and the wellbore which may be cased or uncased. Once in this annulus, a portion of the gravel in the fluid slurry is deposited around the apparatus in the annulus such that the gravel migrates both circumferentially and axially from the outlets. This process progresses along the entire length of the apparatus such that the annular area becomes completely packed with the gravel. In addition, a portion of the fluid slurry enters the opening in the production sections of the outer tubular which provides for the deposit of a portion of the gravel from the fluid slurry in the production pathways between the outer tubulars and the sand control screen assemblies. Again, this process progresses along the entire length of the apparatus such that each production pathway becomes completely packed with the gravel. Once both the annulus and the production pathways are completely packed with gravel, the gravel pack operation may cease.

Figure 15:
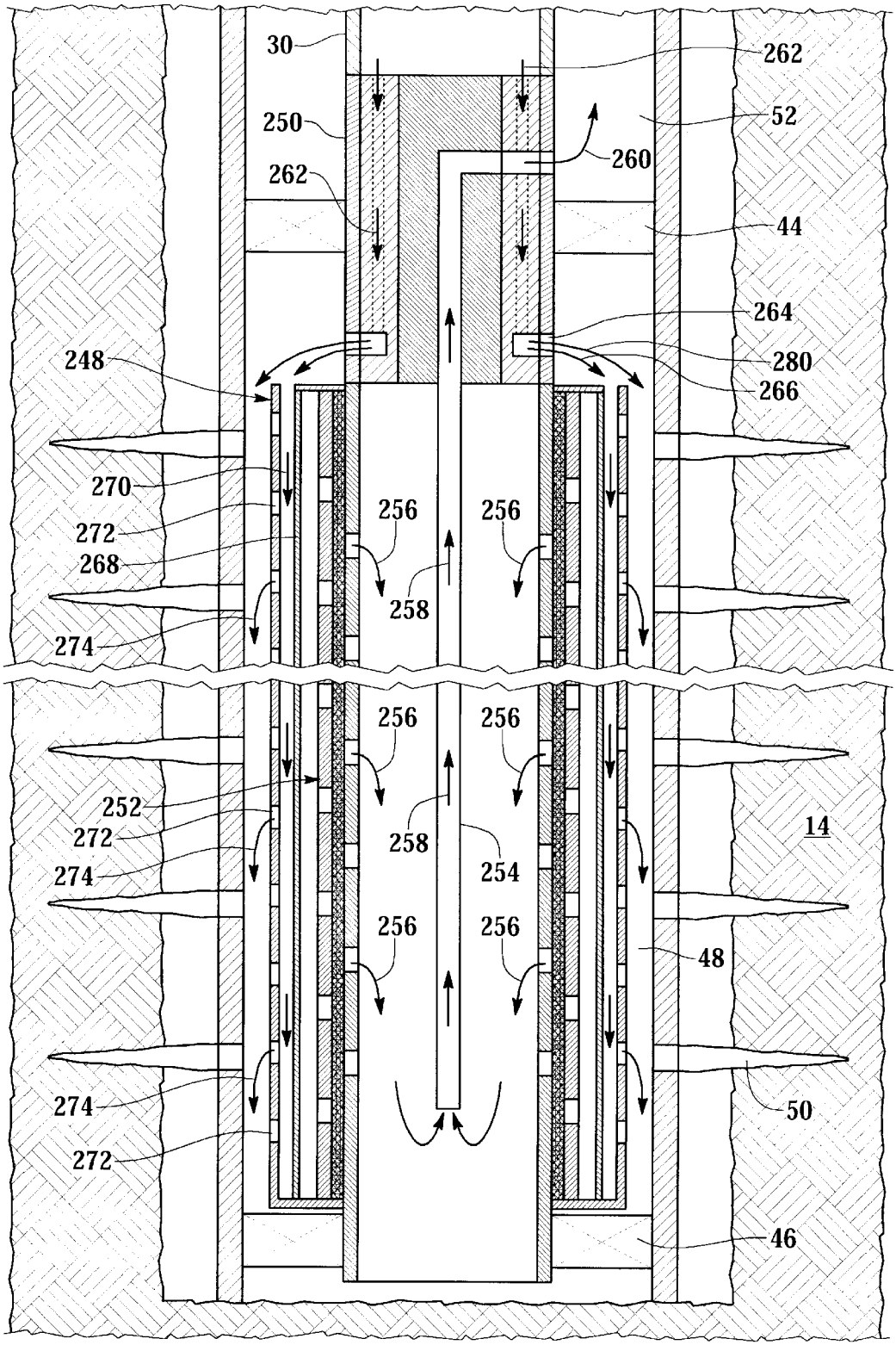
FIG. 15 is a half sectional view depicting the operation of another embodiment of an apparatus for gravel packing an interval of a wellbore of the present invention.

In some embodiments of the present invention, the fluid slurry may not only be injected into the slurry passageways, but also injected directly into the annulus between the apparatus and the wellbore, as best seen in FIG. 15. In the illustrated embodiment, the primary path for the fluid slurry containing gravel as it is discharged from exit ports 264, is directly into annular interval 48 as indicated by arrows 280. This is the primary path as the fluid slurry seeks the path of least resistance. Under ideal conditions, the fluid slurry travels throughout the entire interval 48 until interval 48 is completely packed with gravel. In addition, the fluid slurry enters the production pathways of apparatus 248 such that the annulus between apparatus 248 and sand control screen assembly 252 is also completely packed with gravel.

It has been found, however, that sand bridges commonly form during the gravel packing of an interval when the fluid slurry is pumped directly into annular interval 48. These sand bridges are bypassed using the apparatus for gravel packing on an interval of a wellbore of the present invention by first allowing the fluid slurry to pass through the outer tubular into the production pathways of apparatus 248, bypass the sand bridge and then return to annular interval 48 through the outer tubular to complete the gravel packing process. These pathways are considered the secondary path for the fluid slurry. If a sand bridge forms in the secondary paths prior to completing the gravel packing operation, then the fluid slurry enters channels 268 as indicated by arrows 266 and as described above with reference to FIG. 14. In this embodiment, the channels 268 are considered the tertiary path for the fluid slurry.

In either embodiment, once the gravel pack is completed and the well is brought on line, formation fluids that are produced into the gravel packed interval must travel through the gravel pack in the annulus, then enter the production pathways through the openings in the outer tubular where the formation fluids pass through the gravel pack between the outer tubular and the screen assembly. As such, the apparatus for gravel packing an interval of a wellbore of the present invention allows for a complete gravel pack of an interval so that particulate materials in the formation fluid are filtered out.

Figure 16:
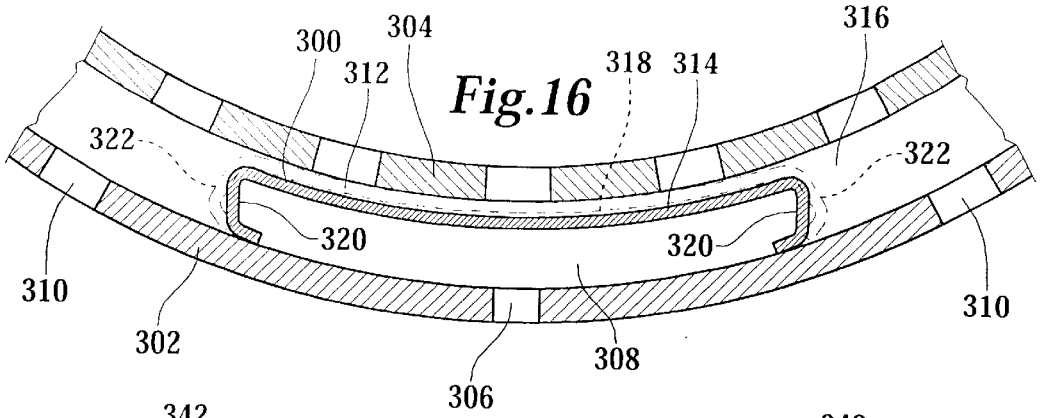
FIG. 16 is a cross sectional view of the deformation of a channel during the operation of an apparatus for gravel packing an interval of a wellbore of the present invention.

One of the unique features of the apparatus for gravel packing an interval of a wellbore of the present invention is illustrated in FIG. 16. Specifically, the channels used to create the slurry passageways in the present invention have pressure relief capability which prevent catastrophic failures such as those which have occurred with the uses of shunt tubes. As illustrated, a channel 300 is positioned between an outer tubular 302 and a screen housing 304. At the location of this cross section, no attachment member, such as studs 170 described above, is visibly attaching channel 300 to outer tubular 302. As explained above, the attachment members are positioned at preselected intervals along the length of channel 300. At this cross section, an outlet 306 is depicted which allows for the discharge of the fluid slurry containing gravel from slurry passageway 308. Also depicted are two openings 310 in outer tubular 302 which represent the entries into the production pathways of outer tubular 302.

As illustrated by the solid lines representing channel 300, when channel 300 is unstressed or is operating under normal pressure conditions, a gap 312 exists between the web 314 of channel 302 and the outer surface of screen housing 304. Gap 312 will typically be filled with gravel during a gravel packing operation as the fluid slurry containing gravel will exit outlets 306, reenter outer tubular 302 through openings 310 and migrate into gap 312 as the gravel fills annulus 316 between outer tubular 302 and screen housing 304. It should be noted that gaps 312 also allow production fluids to be produced through this area of screen housing 304 since channel 300 does not impede such flow.

Importantly, under abnormally high pressure conditions caused, for example by a pressure spike, channel 300 will deform instead of failing. Specifically, web 314 of channel 300 will deform as shown in the dotted section 318 of web 314. Web 314 can deform until it makes contact with the outer surface of screen housing 304. In addition, the sides 320 of channel 300 may also deform as shown in the dotted sections 322 of channel 300. As sides 320 deform, the contact between sides 320 and the inner surface of outer tubular 302 increase which enhances the seal between the two. Also, such flexure tends to reduce to possibility of having sand lockages in slurry passageway 308. In fact, under sufficient pressure conditions, sides 320 will deform to allow discharge of the fluid slurry between sides 320 and the inside surface of outer tubular 302, thereby providing pressure relief and avoiding damage to channel 300.

Once the high pressure condition is relieved, channel 300 will return substantially to its original shape such that normal operation may continue. In addition, as the gravel in the fluid slurry will build up around sides 320 in the pressure relief operation, this gravel will tend to provide a seal between sides 320 and the inner surface of outer tubular 302 even if channel 300 does not fully return to its original position. To provide this relief capability, channel 300 may be formed from a sheet metal such as a 16-gage 316 L stainless steel. Other thicknesses of sheet metal have also been found suitable for the construction of channel 300 including, but not limited to, sheet metals between about 12-gage and 20-gage. In addition, channel 300 may be constructed from other materials including, but not limited to, other stainless steels such as 304 stainless steel.

Figure 17:
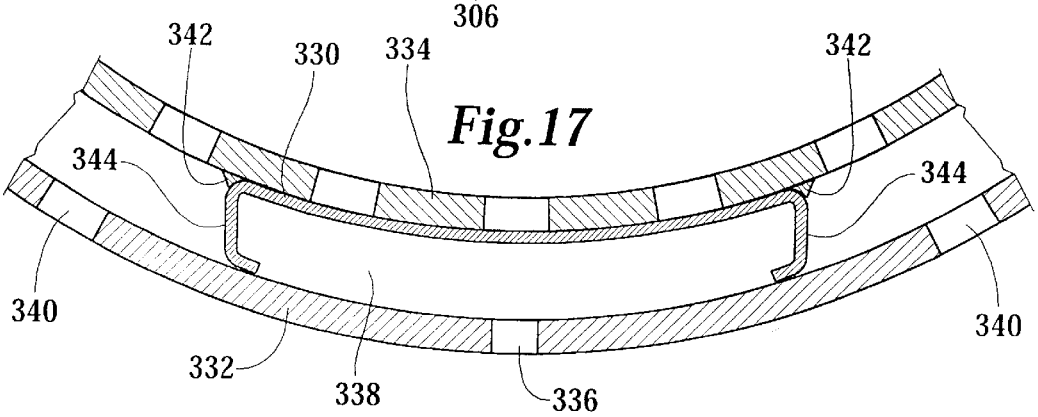
FIG. 17 is a cross sectional view of a channel of an apparatus for gravel packing an interval of a wellbore of the present invention attached to an outer housing of a sand control screen.

The pressure relief capability of the present invention can be alternatively achieved by attaching the channels to the screen housing instead of to the outer tubular. As best seen in FIG. 17, a channel 330 is positioned between an outer tubular 332 and a screen housing 334. At this cross section, an outlet 336 is depicted which allows for the discharge of the fluid slurry containing gravel from slurry passageway 338. Also depicted are two openings 340 in outer tubular 332 which represent the entries into the production pathways of outer tubular 332. In the illustrated embodiment, instead of attaching channel 330 to outer tubular 332, channel 330 is attached to screen housing 334 by one or more welds 342. In this embodiment, channel 330 is attached to screen housing 334 then outer tubular 332 is positioned around the sand control screen and channel assembly to create slurry passageway 338. When channel 330 is unstressed or is operating under normal pressure conditions, sides 344 are in contact with the inner surface of outer tubular 332. As explained above, under abnormally high pressure conditions, channel 330 will deform instead of failing. Specifically, the sides 344 of channel 330 will deform and, under sufficient pressure conditions, sides 344 will allow discharge of the fluid slurry between sides 344 and the inner surface of outer tubular 332, thereby providing pressure relief and avoiding damage to channel 330. Again, once the high pressure condition is relieved, channel 330 will return substantially to its original shape such that normal operation may continue.

Figure 18:
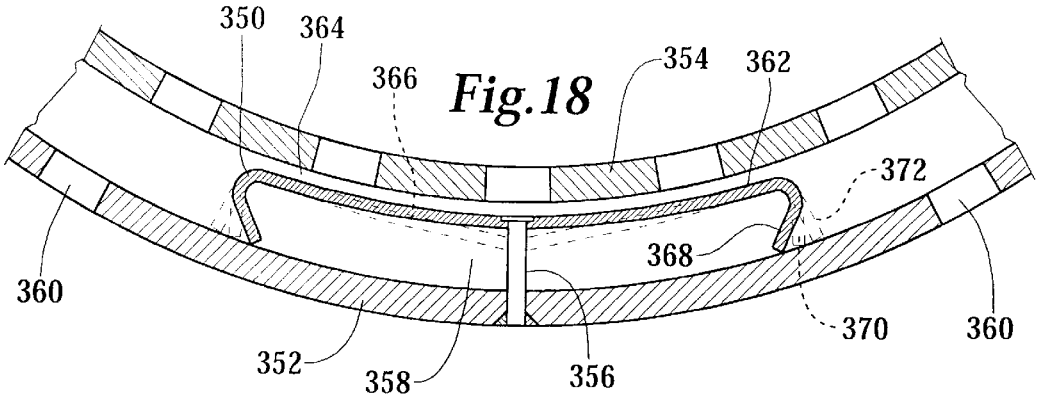
FIG. 18 is a cross sectional view depicting several embodiments of a channel of an apparatus for gravel packing an interval of a wellbore of the present invention.

Referring now to FIG. 18, several embodiments of a channel for use with an apparatus for gravel packing an interval of a wellbore are depicted. A channel 350 is positioned between an outer tubular 352 and a screen housing 354. At this cross section, a stud 356 is depicted which attaches channel 350 to outer tubular 352 such that a slurry passageway 358 is formed. Also depicted are openings 360 in outer tubular 352 which represent the entries into the production pathways of outer tubular 352. Channel 350 includes a web 362, depicted in solid lines, that creates a gap 364 that has a substantially uniform thickness. As should be understood by those skilled in the art, alternate configurations of the web of channel 350 are possible and are considered within the scope of the present invention such as web 366 depicted in dotted lines. Likewise, as should be understood by those skilled in the art, a variety of configurations are possible for the sides of channel 350. For example, sides 368, which are depicted in solid lines, form about a 45-degree angle with web 362, sides 370, which are depicted in dotted lines, form about a 60-degree angle with web 362 and sides 372, which are depicted in dotted lines, form about a 90-degree angle with web 362. Other angles, greater than, less than and in between those described are also possible and are considered within the scope of the present invention. Also, unlike the channels described above that have rolled end sections where the sides of the channels contact the inner surface of the outer tubular, channel 350 is depicted as having sides with square ends that contact the inner surface of outer tubular 352.

Figure 19:
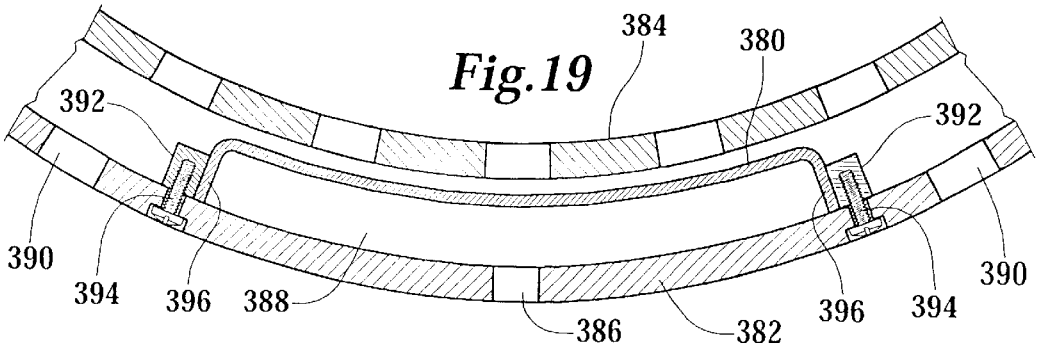
FIG. 19 is a cross sectional view of another embodiment of a channel of an apparatus for gravel packing an interval of a wellbore of the present invention.

It should be noted that the apparatus for gravel packing an interval of a wellbore of the present invention may alternatively be constructed without pressure relief capability. As illustrated in FIG. 19, a channel 380 is positioned between an outer tubular 382 and a screen housing 384. Outer tubular 382 includes an outlet 386 for the discharge of the fluid slurry from slurry passageway 388. Outer tubular 382 also includes openings 390 which are the entries to the production pathways of outer tubular 382. At the location of this cross section, no attachment member, such as studs 170 described above, is visibly attaching channel 380 to outer tubular 382. In fact, in this embodiment, no such attachment member may be required. Specifically, retainer members 392 are used to hold channel 380 in place. As illustrated, channel 380 is allowed to move radially between screen housing 384 and outer tubular 383 during operation and installation, thereby accounting for variations in the annular space between screen housing 384 and outer tubular 383 caused by tolerance in outer tubular 383. Accordingly, ends 396 of channel 380 can move radially relative to retainer members 392, however, a close relationship between ends 396 and retainer members 392 may be maintained to effect a seal.

In the illustrated embodiment, retainer members 392 are attached to outer tubular 382 with threaded bolts 394, however, other types of attachment members, such as rivets or the like, may be used. Retainer members 392 may extend substantially along the entire length of channel 380 or a plurality of retainer members 392 may be places at intervals along the length of channel 380. Alternatively, channel 380 may receive threaded bolts or other types of attachment members directly into ends 396 of channel 380.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for gravel packing an interval of a wellbore, the apparatus comprising:

a sand control screen positioned within the wellbore;

a tubular member disposed within the wellbore forming a first annulus with the sand control screen and a second annulus with the wellbore, the tubular member having an axially extending production section with a plurality of openings and an axially extending nonproduction section with a plurality of outlets; and a channel disposed within the first annulus that is substantially circumferentially aligned with the nonproduction section of the tubular member forming a slurry passageway therewith.

2. The apparatus as recited in claim 1 wherein he channel further comprising a web and a pair of oppositely disposed sides.

3. The apparatus as recited in claim 2 wherein the web and each of the sides have an angle therebetween of between about 45 and 90 degrees.

4. The apparatus as recited in claim 2 wherein the sides have square ends.

5. The apparatus as recited in claim 2 wherein the sides have rolled ends.

6. The apparatus as recited in claim 2 wherein the sides contact an inner surface of the tubular member when the pressure within the slurry passageway is below a predetermined value and wherein at least one of the sides partially separates from the inner surface of the tubular member when the pressure within the slurry passageway is above the predetermined value.

7. The apparatus as recited in claim 2 wherein an attachment member is used to connect the web of the channel to the tubular member.

8. The apparatus as recited in claim 2 wherein the channel is connected to the sand control screen.

9. The apparatus as recited in claim 2 wherein a retainer member is used to support each of the sides of the channel within the tubular member.

10. The apparatus as recited in claim 1 wherein the tubular member further comprises first and second axially extending production sections and first and second axially extending nonproduction sections and wherein the apparatus further comprises first and second channels that are substantially circumferentially aligned with the first and second nonproduction sections of the tubular member, respectively, forming first and second slurry passageways therewith.

11. The apparatus as recited in claim 1 wherein the tubular member further comprises first, second, third and fourth axially extending production sections and first, second, third and fourth axially extending nonproduction sections and wherein the apparatus further comprises first, second, third and fourth channels that are substantially circumferentially aligned with the first, second, third and fourth nonproduction sections of the tubular member, respectively, forming first, second, third and fourth slurry passageways therewith.

12. An apparatus for gravel packing an interval of a wellbore, the apparatus comprising:

a sand control screen positioned within the wellbore;

a tubular member disposed within the wellbore forming a first annulus with the sand control screen and a second annulus with the wellbore, the tubular member having an inner surface, an axially extending production section with a plurality of openings and an axially extending nonproduction section with a plurality of outlets; and a channel disposed within the first annulus that is substantially circumferentially aligned with the nonproduction section of the tubular member forming a slurry passageway therewith, the channel having a web and a pair of oppositely disposed sides, the sides contacting the inner surface of the tubular member when the pressure within the slurry passageway is below a predetermined value and at least one of the sides partially separating from the inner surface of the tubular member when the pressure within the slurry passageway is above the predetermined value.

13. The apparatus as recited in claim 12 wherein the web and each of the sides have an angle therebetween of between about 45 and 90 degrees.

14. The apparatus as recited in claim 12 wherein the sides rave square ends.

15. The apparatus as recited in claim 12 wherein the sides have rolled ends.

16. The apparatus as recited in claim 12 wherein an attachment member is used to connect the web of the channel to the tubular member.

17. The apparatus as recited in claim 12 wherein the channel is connected to the sand control screen.

18. The apparatus as recited in claim 12 wherein a retainer member is used to support each of the sides of the channel within the tubular member.

19. The apparatus as recited in claim 12 wherein the tubular member further comprises first and second axially extending production sections and first and second axially extending nonproduction sections and wherein the apparatus further comprises first and second channels that are substantially circumferentially aligned with the first and second nonproduction sections of the tubular member, respectively, forming first and second slurry passageways therewith.

20. The apparatus as recited in claim 12 wherein the tubular member further comprises first, second, third and fourth axially extending production sections and first, second, third and fourth axially extending nonproduction sections and wherein the apparatus further comprises first, second, third and fourth channels that are substantially circumferentially aligned with the first, second, third and fourth nonproduction sections of the tubular member, respectively, forming first, second, third and fourth slurry passageways therewith.

21. A method for gravel packing an interval of a wellbore, the method comprising the steps of:

traversing a formation with the wellbore;

locating a sand control screen within the wellbore proximate the formation;

positioning a tubular member within the wellbore forming a first annulus with the sand control screen and a second annulus with the wellbore, the tubular member having an axially extending production section with a plurality of openings and an axially extending nonproduction section with a plurality of outlets;

disposing a channel within the first annulus such that the channel is substantially circumferentially aligned with the nonproduction section of the tubular member forming a slurry passageway therewith;

injecting a fluid slurry containing gravel through the slurry passageway such that the fluid slurry exits the slurry passageway through the outlets; and terminating the injecting when the interval is substantially completely packed with the gravel.

22. The method as recited in claim 21 wherein the step of disposing a channel within the first annulus further comprises disposing a channel having a web and a pair of oppositely disposed sides within the first annulus channel.

23. The method as recited in claim 22 further comprising the step of forming the channel such that the angle between the web and each of the sides is between about 45 and 90 degrees.

24. The method as recited in claim 22 further comprising the step of forming the channel such that the ends of the sides are square.

25. The method as recited in claim 22 further comprising the step of forming the channel such that the ends of the sides are rolled.

26. The method as recited in claim 22 further comprising contacting the sides of the channel with an inner surface of the tubular member when the pressure within the slurry passageway is below a predetermined value and relieving pressure from the slurry passageway by allowing at least one of the sides to partially separate from the inner surface of the tubular member when the pressure within the slurry passageway is above the predetermined value.

27. The method as recited in claim 21 further comprising attaching the channel to the tubular member with an attachment member connected to a web of the channel.

28. The method as recited in claim 21 further comprising attaching the channel to the sand control screen.

29. The method as recited in claim 21 further comprising supporting each of the sides of the channel within the tubular member with a retainer member.

30. A method for gravel packing an interval of a wellbore, the method comprising the steps of:

traversing a formation with the wellbore;

locating a sand control screen within the wellbore proximate the formation;

positioning a tubular member within the wellbore forming a first annulus with the sand control screen and a second annulus with the wellbore, the tubular member having an axially extending production section with a plurality of openings and an axially extending nonproduction section with a plurality of outlets;

disposing a channel having a web and a pair of oppositely disposed sides within the first annulus such that the channel is substantially circumferentially aligned with the nonproduction section of the tubular member forming a slurry passageway therewith;

injecting a fluid slurry containing gravel through the slurry passageway such that the fluid slurry exits the slurry passageway through the outlets;

contacting the sides of the channel with an inner surface of the tubular member when the pressure within the slurry passageway is below a predetermined value;

relieving pressure from the slurry passageway by allowing at least one of the sides to partially separate from the inner surface of the tubular member when the pressure within the slurry passageway is above the predetermined value; and terminating the injecting when the interval is substantially completely packed with the gravel.

31. The method as recited in claim 30 further comprising the step of forming the channel such that the angle between the web and each of the sides is between about 45 and 90 degrees.

32. The method as recited in claim 30 further comprising the step of forming the channel such that the ends of the sides are square.

33. The method as recited in claim 30 further comprising the step of forming the channel such that the ends of the sides are rolled.

34. The method as recited in claim 30 further comprising attaching the channel to the tubular member with an attachment member connected to the web of the channel.

35. The method as recited in claim 30 further comprising attaching the channel to the sand control screen.

36. The method as recited in claim 30 further comprising supporting each of the sides of the channel within the tubular member with a retainer member.

* * * * *